United States Patent [19]

Runkel

[11] Patent Number: 4,724,588

[45] Date of Patent: Feb. 16, 1988

[54] YARN TEXTURING NOZZLE

[75] Inventor: Walter Runkel, Remscheid, Fed. Rep. of Germany

[73] Assignee: Barmag AG, Remscheid, Fed. Rep. of Germany

[21] Appl. No.: 853,713

[22] Filed: Apr. 18, 1986

[30] Foreign Application Priority Data

Jul. 20, 1985 [DE] Fed. Rep. of Germany ..... 3525992

[51] Int. Cl.[4] ..... D02G 1/12; D02G 1/16

[52] U.S. Cl. ..... 28/255; 28/272

[58] Field of Search ..... 28/255, 256, 272

[56] References Cited

U.S. PATENT DOCUMENTS

| | | | |
|---|---|---|---|
| 2,812,850 | 11/1957 | Pape | 28/272 X |
| 3,373,470 | 3/1968 | Joly . | |
| 3,482,294 | 12/1969 | Joly . | |
| 3,828,404 | 8/1974 | Peckinpaugh et al. . | |
| 4,563,799 | 1/1986 | Dammann | 28/272 |

FOREIGN PATENT DOCUMENTS

| | | |
|---|---|---|
| 26360 | 4/1981 | European Pat. Off. . |
| 108205 | 5/1984 | European Pat. Off. . |
| 110359 | 6/1984 | European Pat. Off. . |
| 123072 | 10/1984 | European Pat. Off. . |
| 2632083 | 1/1978 | Fed. Rep. of Germany . |
| 7723587 | 1/1979 | Fed. Rep. of Germany . |
| 2840177 | 3/1980 | Fed. Rep. of Germany . |
| 54-2450 | 1/1979 | Japan . |

*Primary Examiner*—Robert R. Mackey

*Attorney, Agent, or Firm*—Bell, Seltzer, Park & Gibson

[57] ABSTRACT

A yarn texturing nozzle is disclosed which comprises a rigid yarn feeding inlet portion wherein a yarn is subjected to a heated and pressurized treatment fluid to heat the yarn and also advance the yarn therethrough. The nozzle also includes a stuffer box comprising a thin walled tube which is located downstream of the inlet portion. The inlet portion comprises a block-like casing having a cylindrical bore extending therethrough, and a guide cylinder which is rotatably mounted in the bore and which includes a central yarn passageway. The casing and guide cylinder of the inlet portion include yarn thread-up slots which may be aligned by rotation of the guide cylinder to a thread-up position, and the guide cylinder may then be rotated to an operating position wherein the slots are non-aligned. The stuffer box also includes a thread-up slot which is aligned either with the slot in the casing of the inlet portion, or with the slot of the guide cylinder, and the slot of the stuffer box is adapted to be closed during operation of the nozzle.

11 Claims, 17 Drawing Figures

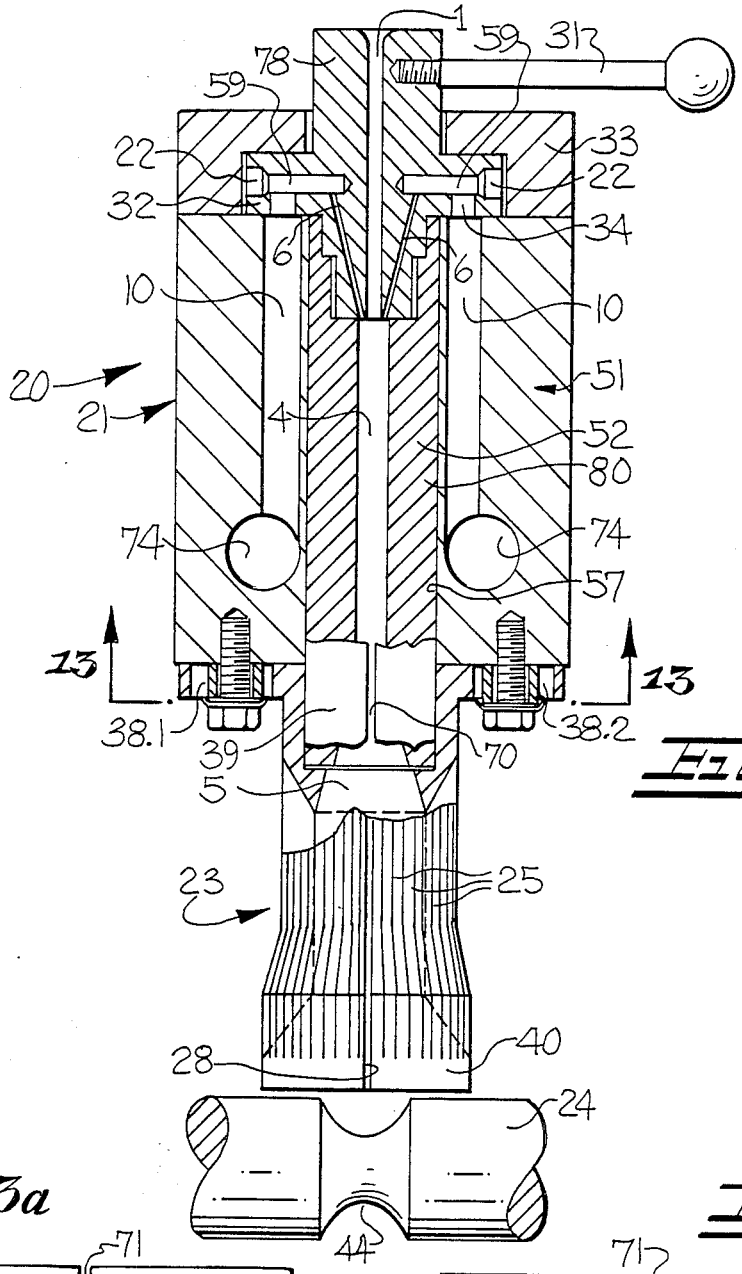
Fig-12
Fig-13a
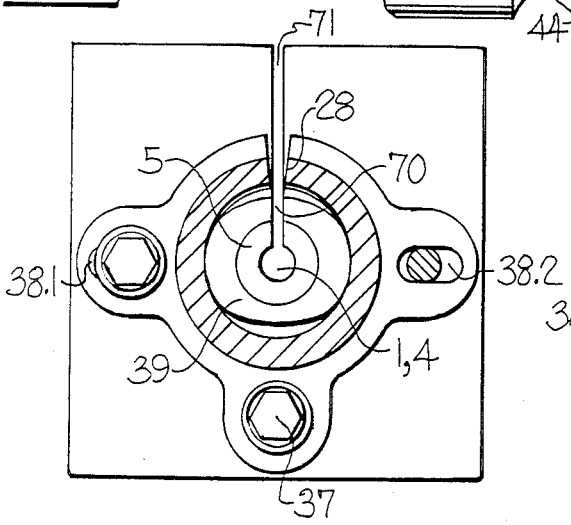
Fig-13b
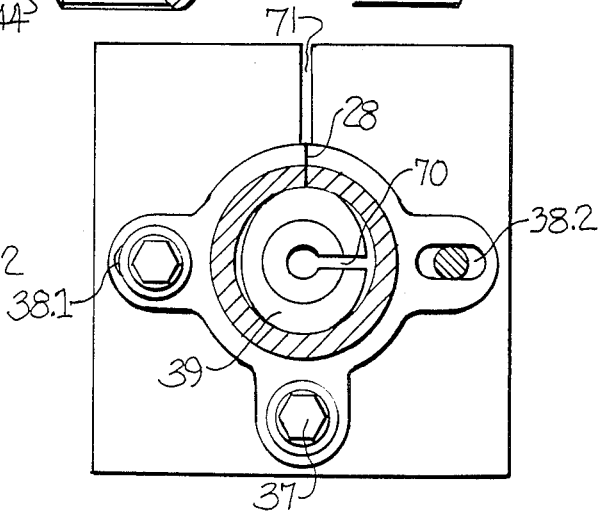

YARN TEXTURING NOZZLE

BACKGROUND OF THE INVENTION

The present invention relates to a yarn texturing nozzle, and which comprises a yarn feeding inlet portion and a perforated stuffer box portion. The inlet portion includes a yarn passageway, and the yarn is heated and advanced through the passageway by a treatment fluid which is supplied through internal ducts which are inclined with respect to the yarn passageway. The nozzle includes a slot for the purpose of threading a yarn, and the slot extends along an axial plane which includes the yarn passageway, with provision made for opening and closing the slot.

German AS No. 1,435,653 and U.S. Pat. Nos. 3,373,470 and 3,482,294 discloses an apparatus for the continuous stuffer box crimping of a thermoplastic yarn, and wherein a heated treatment fluid advances the yarn by means of an injector into a stuffing chamber having a side wall which is permeable to the fluid. The yarn forms a plug in the stuffing chamber, and at the outlet end the yarn is drawn off and wound.

Other apparatus of the described type are illustrated in German OS No. 26 32 083 and German GM No. 77 23 587. The apparatus described in these prior patents have been proven in operation with respect to the quality of the crimping. However, all of the known prior apparatus of this type have an important disadvantage, in that the thread-up of the yarn is extremely tedious and time consuming. For example, where it becomes necessary to rethread the yarn during a continuous operation, such as after a yarn break or the like, the thread-up can be done only after the hot pressurized gas has been turned off, and it may also be necessary to wait until the apparatus has cooled before thread-up can be accomplished.

Published European patent applications Nos. 108,205; 123,072; 26,360; and 110,359 illustrate prior attempts to facilitate the opening of the texturing nozzle, by constructing the nozzle in two halves which are sealably pressed against each other during operation. This arrangement is only possible however, when the inlet portion and the adjacent stuffer box are identically designed with respect to their strength. For this reason, special steps must be taken for improving the strength of the stuffer box.

It is accordingly an object of the present invention to provide a yarn texturing nozzle of the described type, and wherein the thread-up of the yarn into the nozzle is readily facilitated and without requiring any change in the operating condition of the nozzle.

It is also an object of the present invention to avoid the disadvantages of the known apparatus and methods as described above, and to provide a nozzle which can be opened so as to insure a simple and rapid threading of the advancing yarn into the nozzle without adversely affecting its efficiency. The nozzle should also be designed to enable an efficient construction of the stuffer box which assures the outflow of the treatment fluid, and which does not require a particularly strong design of the stuffer box.

SUMMARY OF THE INVENTION

These and other objects and advantages of the present invention are achieved in the embodiments disclosed herein by the provision of a yarn texturing nozzle which comprises a yarn feeding inlet portion and a stuffer box, with the yarn feeding inlet portion being of rigid construction and comprising a casing having a cylindrical bore extending therethrough. Also, the inlet portion includes a guide cylinder rotatably received within the bore of the casing, with the guide cylinder extending along at least a substantial portion of the axial length of the bore. The guide cylinder includes a yarn passageway extending axially through the length thereof and defining an inlet end and an outlet end. In addition, the casing has an axial slot extending laterally between the bore and the outer periphery of the casing, and the guide cylinder also includes an axial slot extending laterally between the yarn passageway and the outer periphery of the insert. The guide cylinder is rotatable with respect to the casing between a thread-up position wherein the slot of the cylinder is aligned with the slot of the casing, and an operating position wherein the slots are non-aligned and the slot of the cylinder is covered by the casing.

The guide cylinder of the present invention also includes at least one internal duct communicating with the yarn passageway and being inclined with respect to the axis of the passageway so as to be directed toward the outlet end. In addition, there is provided conduit means for connecting each internal duct to a source of pressurized treatment fluid, such as heated air, and such that the yarn is heated and advanced toward the outlet end.

The yarn texturing nozzle of the present invention further comprises a tubular stuffer box mounted to abut the outlet end of the casing in coaxial communication with the outlet of the yarn passageway, and the stuffer box includes a relatively thin peripheral side wall having opening means extending therethrough for permitting the treatment fluid to exhaust laterally through the side wall. Also, the stuffer box includes a yarn inserting slot extending through the side wall to facilitate yarn thread-up. In one preferred embodiment, the stuffer box is fixedly mounted to the casing, with the slot of the stuffer box being aligned with the slot of the casing.

In the above described nozzle, the yarn feeding inlet portion comprises a structural member which is mechanically separate from the stuffer box. This arrangement facilitates the design of the inlet portion, since it will be understood that a high air pressure may exist in the inlet portion, and the air may be heated, so that not only a high kinetic energy may be imparted to the yarn but also a high thermal energy. Also, it must be assured that leakage of the treatment fluid is avoided to the extent possible.

With the present invention, the guide cylinder may be accurately fitted into the bore of the casing, so that aside from the threading slot, no leakage can occur. However, to insure that the guide cylinder may be rotated with respect to the casing at any time, despite the extremely close tolerances between the cylinder and the bore, the present invention provides that the operating temperature of the guide cylinder will not be higher than that of the surrounding casing, during instances where the treatment fluid is heated. This advantage is accomplished, in that the casing is preheated by delivery channels which extend parallel to the bore and thus the guide cylinder, with the channels being connected to an inlet for the heated and pressurized treatment fluid at one end, and to the internal ducts in the guide cylinder at the other end. The heated and pressurized treatment fluid thus enters into the casing, preferably in the vicinity of the lower end, and is conducted through a substantial portion of the length of the casing so as to heat the casing to a temperature which is in general, slightly above that of the guide cylinder, but in no event less than the temperature of the cylinder.

It is preferred that the treatment fluid flow through the casing, since this facilitates the thermal heat transfer through the nozzle and also facilitates the supply of the fluid. Also, the outlets of the delivery channels of the casing are disposed with respect to the bore, so that they communicate with a radial connecting duct in the guide cylinder in at least the operating position. Preferably however, the delivery channels of the casing and the connecting duct of the guide cylinder communicate with each other in both the operating position and the threading position. By this arrangement, it may be insured that the yarn can be advanced with the aid of the pressurized treatment fluid in the threading position, and that both the nozzle and the yarn may be maintained at operating temperature during the thread-up operation.

With respect to the stuffer box, it has been known that the stuffer box should be designed so as to facilitate the outflow of the treatment fluid, as well as the withdrawal of the yarn plug, and that these requirements are difficult to achieve when the stuffer box is of a massive design. In accordance with the present invention, the stuffer box comprises a thin walled tube, and it is a separate structural member which is connected with one of the components of the inlet portion. Also, the stuffer box is in all cases provided with a threading slot, which may be aligned with the threading slot of the inlet portion in the thread-up position. In one embodiment of the invention, the threading slot of the stuffer box may be closed by a plate, which can be inserted into the slot and which extends substantially to its inside periphery. It has been found that a plate of this type is an excellent closing member, since it can be designed to leave slots on both sides of the plate which can have a width substantially the same as the other slots of the stuffer box. In this manner, it becomes possible to achieve a uniform flow pattern of the fluid from the stuffer box.

In an alternative embodiment, the stuffer box is internally biased so that the threading slot is normally closed, and an expanding means is provided to open the slot for thread-up. Such expanding means may for example comprise an end portion of the guide cylinder which is received in a receptacle at the inlet end of the stuffer box. The end portion of the guide cylinder and the receptacle include cooperating cam surfaces, such that the stuffer box may be expanded to open the slot by rotation of the cylindrical insert. Alternatively, it is possible to connect the mating surfaces of the stuffer box and cylindrical insert by means of curved slots on one of the members and cooperating pins mounted on the other of the members. The slots are eccentrically curved with respect to the guide cylinder, and such that the interconnection between the pins and slots may be used for either spreading the stuffer box open when the stuffer box is internally biased to close the slot, or to close the slot when the stuffer box is internally biased toward the open position.

BRIEF DESCRIPTION OF THE DRAWINGS

Some of the objects and advantages of the present invention having been stated, others will appear as the description proceeds, when taken in conjunction with the accompanying drawings, in which

FIG. 12 is a sectional side elevation view of a second embodiment of a nozzle in accordance with the present invention;

FIGS. 13*a* and 13*b* are sectional top plan views taken substantially along the line 13—13 of FIG. 12, and illustrating the thread-up position and the operating position respectively;

DETAILED DESCRIPTION OF THE PREFERRED EMBODIMENTS

Figure 1:
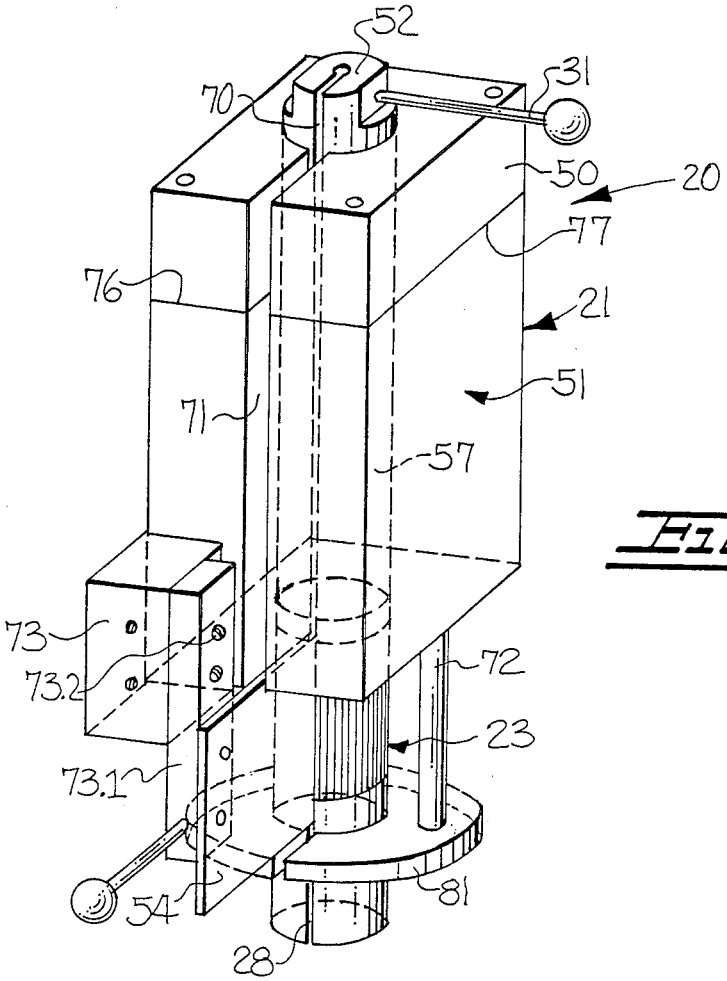
FIG. 1 is a perspective view of a yarn texturing nozzle which embodies the features of the present invention.

Referring more particularly to the drawings, FIG. 1 illustrates a yarn texturing nozzle embodying the features of the present invention, and which comprises a yarn feeding inlet portion 20, and a stuffer box 23. The inlet portion 20 comprises a casing 21 in the form of a rectangular solid, and which is composed of an upper block 50 and a lower block 51 which are interconnected to each other. The casing also includes a cylindrical bore 57 extending therethrough and defining an inlet or upper end as seen in FIG. 1, and an opposite or lower outlet end.

The inlet portion 20 also includes a guide cylinder 52 which is rotatably received within the bore 57 and extends longitudinally through the entire axial length of the bore. The guide cylinder 52 is adapted to be rotated about the axis of the bore by means of an adjusting lever 31.

Figure 1A:
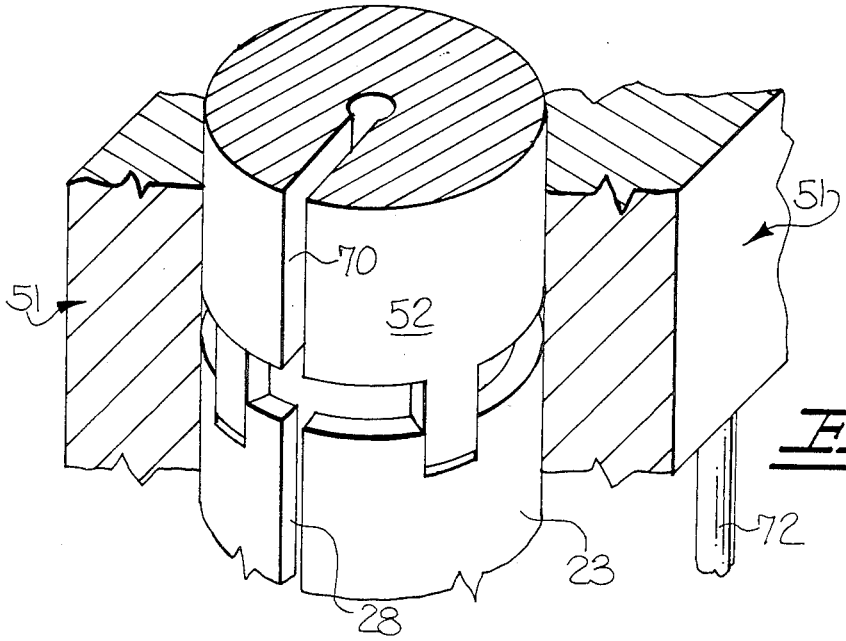
FIG. 1A is a fragmentary and partly sectioned perspective view of the lower portion of the nozzle shown in FIG. 1.
Figure 14:
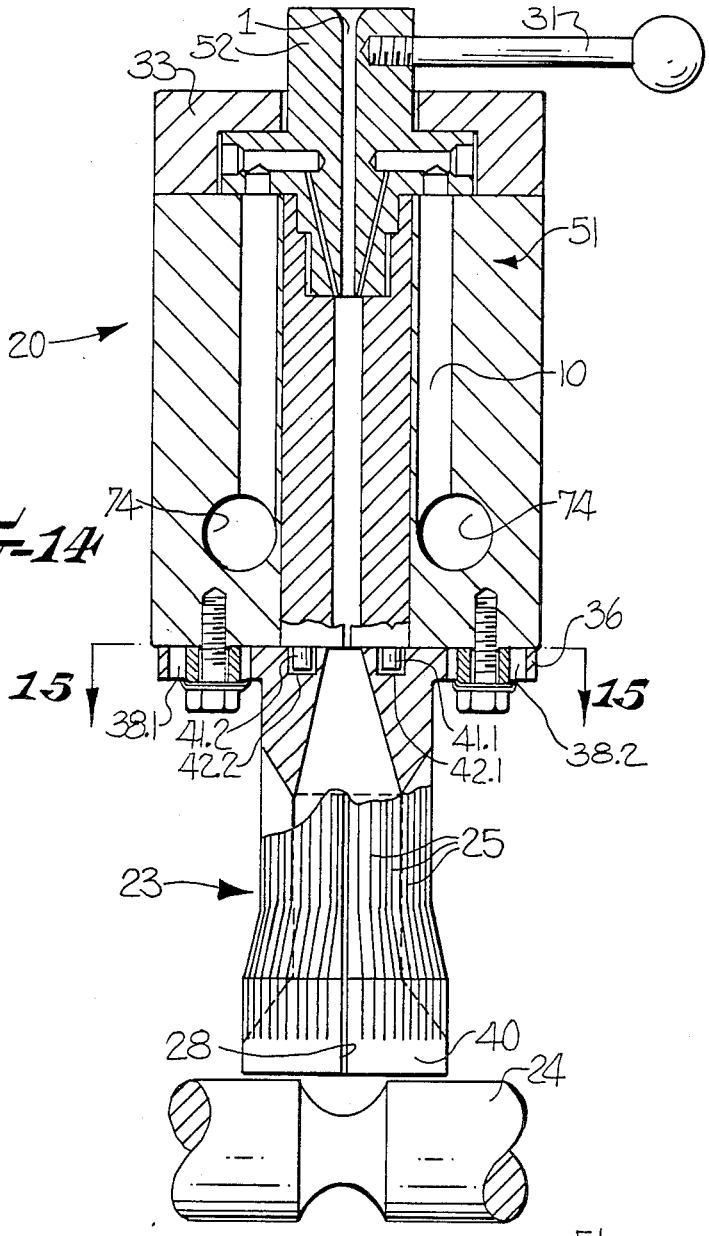
FIG. 14 is a sectional side elevation view illustrating another embodiment of the present invention.

The stuffer box 23 is a relatively thin tube, and is provided in its upper portion with a plurality of narrow, longitudinal slots 25, and is permeable to air in its lower portion. The casing 21, guide cylinder 52, and stuffer box 23 are each provided with a longitudinal slot 71,70, and 28 respectively, to facilitate thread-up. Bolts 72 mount a flange 81 to the bottom of block 51 of the casing. Flange 81 has a central opening which receives the stuffer box 23 in such a way that the stuffer box abuts the lower end portion of the yarn passageway in close communication therewith, avoiding any axial movement of the stuffer box 23 and compensating for the force exerted by the yarn compressed in the stuffer box. Stuffer box 23 may be rotatably received in the central bore of the flange 81, in which case it would be connected to the guide cylinder 52 by bolts or cams or the like to rotate therewith. Such means are shown in FIG. 1A. In this case, slot 28 in stuffer box 23 is in alignment with slot 70 in guide cylinder 52. Another solution also embodied in the drawing of FIG. 1 would be to secure the stuffer box to the casing as shown in FIGS. 12 and 14 (with the flange 81 not being shown in FIGS. 12 and 14). In this latter case, the slot in the stuffer box would be aligned with the slot 71 in casing 51. The slot 28 of the stuffer box may be closed by a plate 54, and the thickness of the plate generally corresponds to the width of the slot. The plate 54 is mounted to a lever 73.1, which is pivotable about an axis 73.2 of pivoting device 73. The axis is perpendicular to the plane which is in alignment with slot 71 in casing 51. The plate is mounted to this axis in such a way that it is movable in said plane. Thus to permit thread-up of a yarn, the plate 54 may be pivoted from the slot 28 with the aid of the pivoting device 73.

As noted above, the casing 21 is composed of the two blocks 50,51, which facilitates its manufacture, and the blocks 50,51 are illustrated in more detail in FIGS. 2–5. It will be understood however, that the casing may alternatively be fabricated of one unitary piece.

Figure 4:
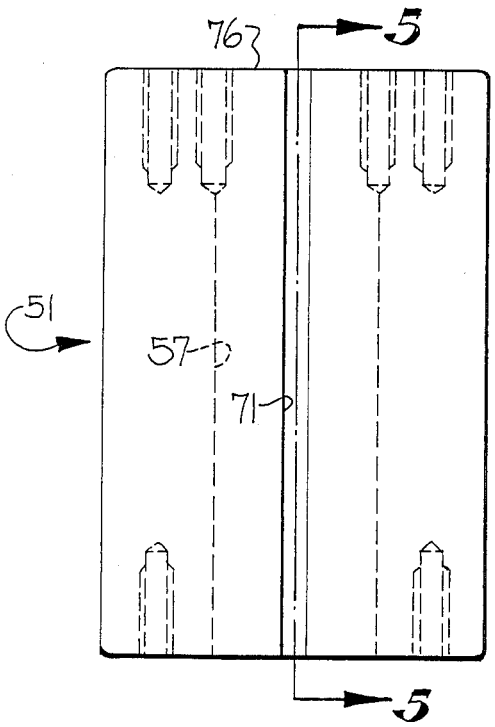
FIG. 4 is a front elevation view of the lower block of the casing of the nozzle shown in FIG. 1.
Figure 5:
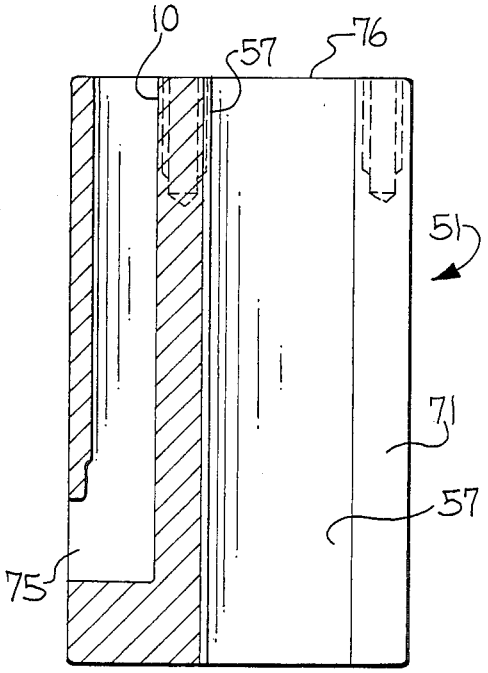
FIG. 5 is a sectional side elevation view of the lower block shown in FIG. 4.
Figure 6:
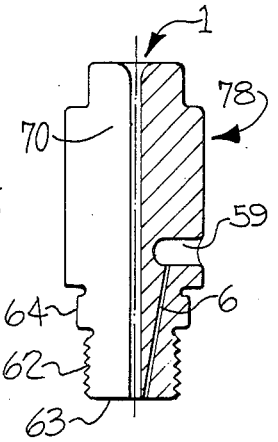
FIG. 6 is a partly sectioned side elevation view of the upper component of the guide cylinder of the nozzle shown in FIG. 1.
Figure 7:
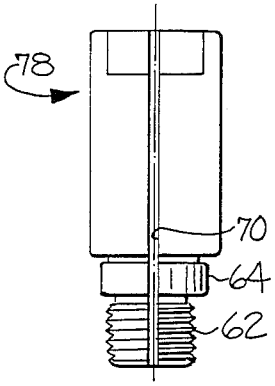
FIG. 7 is a front elevation view of the upper component shown in FIG. 6.
Figure 8:
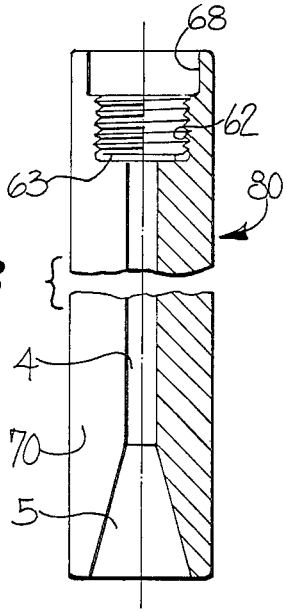
FIG. 8 is a partly sectioned side elevation view of the lower component of the guide cylinder shown in FIG. 1.
Figure 9:
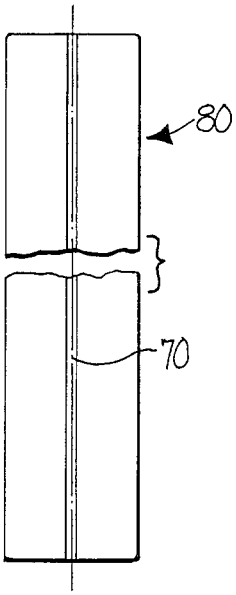
FIG. 9 is a side elevation view of the lower component as shown in FIG. 8.

FIGS. 4 and 5 illustrate the lower block 51, and as seen in FIG. 5, the lower block includes an inlet 75 for the pressurized treatment fluid. The inlet 75 communicates with an axial fluid delivery channel 10 which extends parallel to the bore 57 and terminates at upper surface 76 of the block. The bore 57 is slotted at 71 along its entire axial length, with the slot extending radially from the bore. The bore 57 and slot 71 are preferably formed in the blocks 50,51 after the two blocks are assembled. In this manner, it may be insured that the bore 57 and the yarn threading slot 71 of the two blocks are in precise alignment.

Figure 2:
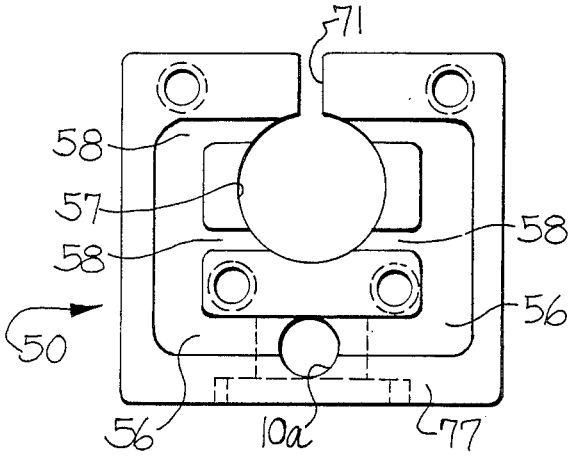
FIG. 2 is a bottom plan view of the upper block of the casing of the nozzle shown in FIG. 1.
Figure 3:
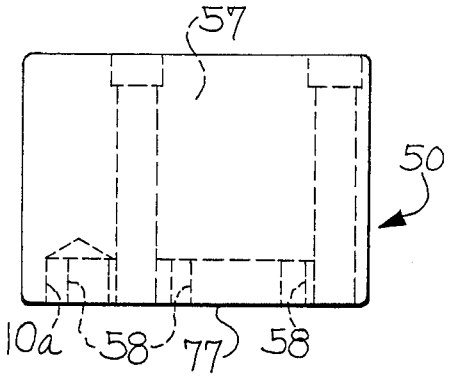
FIG. 3 is a side elevation view of the upper block of the casing of the nozzle shown in FIG. 1.

The upper block 50 of the casing is shown in FIGS. 2 and 3. The bottom surface 77 of the block 50, which is shown in bottom plan view in FIG. 2, accommodates a system of channels. This system includes a blind end bore 10*a*, which is aligned with the delivery channel 10 of the lower block 51 when the two blocks are assembled. From the bore 10*a*, the channel system branches out to two distribution channels 56, which include portions which are disposed on opposite sides of the bore 57. The distribution channels 56 communicate with two branch channels 58 which lead to the bore 57. This system of channels may be formed into the surface 77 of the upper block 50 by a suitable cutting operation, and upon the two blocks 50, 51 being joined together, the cut grooves form a system of channels through which the hot pressurized fluid or vapor may be supplied to the guide cylinder 52.

In the illustrated embodiment, the guide cylinder 52 comprises two components, namely an upper component 78 and a lower component 80, note FIGS. 6–9. The upper component 78 includes a narrow yarn passageway 1, which extends along the axis of the guide cylinder 52. The upper component 78 also includes four radial connecting ducts 59, which are uniformly distributed about its circumference. Four internal ducts 6 are drilled in the upper component 78 from the bottom end surface 63, in such a manner that the internal ducts 6 are disposed on the imaginary surface of an acute angled cone. The upper component 78 also includes a lower male end portion which is threaded at 62.

The lower component 80 of the guide cylinder 52 includes an axial yarn passageway 4 of larger diameter than that of the passageway 1, and the passageway 4 also includes a flared extension 5 at the downstream end which serves as a diffuser. The upper end of the component 80 includes an internally threaded receptacle, for threadedly receiving the lower end of the component 78 in sealed interengagement. Also, the upper and lower components include close fitting cylindrical surfaces 64 and 68, respectively, when the components are assembled. Preferably, both the finishing of the external surfaces of the components 78 and 80, and the formation of the slot 70 are formed after the components have been assembled.

Figure 10:
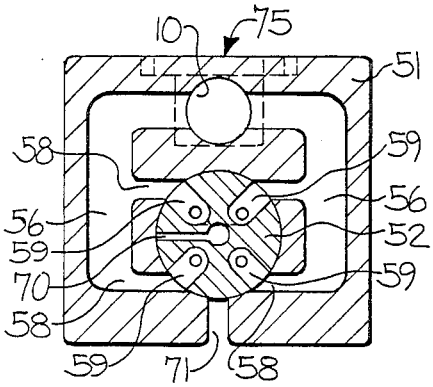
FIG. 10 is a sectional plan view taken through the upper block of the nozzle casing, and illustrating the nozzle in its operating condition.
Figure 11:
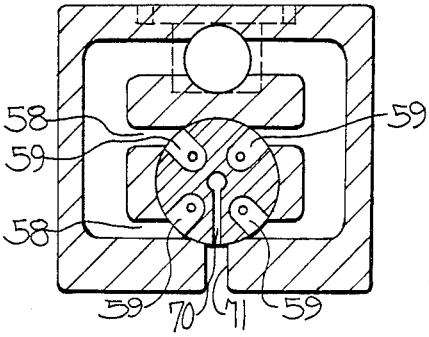
FIG. 11 is a view similar to FIG. 10 but illustrating the nozzle in its thread-up position.

FIGS. 10 and 11 are cross sectional views taken through the upper block 50 of the casing at the elevation of the distribution channels 56, with FIG. 10 illustrating the operating position of the guide cylinder and FIG. 11 illustrating the thread-up position. In the operating position, the threading slot 70 of the guide cylinder 52 is rotated 90° relative to the slot 71 of the blocks 50,51, and so that the slot 70 is covered by the interior wall of the bore 57. In the thread-up position, the two slots 70 and 71 are aligned. In both positions however, the radial connecting ducts 59 of the guide cylinder 52 are connected with branch passages 58 of the channel system in the casing. As a result, the nozzle is supplied with heated gas or the like in both positions.

FIG. 12 is a sectional view of another embodiment of a yarn texturing nozzle in accordance with the present invention, and FIGS. 13*a* and 13*b* are sectional views taken through the stuffer box of this nozzle. The yarn feeding inlet portion 20 of this texturing nozzle again comprises a casing 21 composed of the block 51 and cover 33, and a guide cylinder 52 positioned in a bore 57 in the casing. The guide cylinder 52 is composed of two components, and in this embodiment, the upper component 78 includes an annular shoulder 32 which rests upon the upper surface of the casing block 51. A distributor duct 74 extends within the block 51 on three sides of the bore 57, and is connected with a source of heated and pressurized air or vapor. Several delivery channels 10 proceed axially from the duct 74, and extend in the casing block 51 in a direction parallel to the bore 57. The delivery channels 10 terminate on the upper surface of the block 51. The distributor duct 74 and delivery channels 10 are made to extend along substantially the entire length of the block 51, so that they effect a heating of the block 51.

The bottom side of the annular shoulder 32 and which faces the upper surface of the casing block 51, includes an annular groove 34, which mates with the outlet ends of the delivery channels 10. Four radial connecting ducts 59 extend from the outer periphery of the annular shoulder 32 into the upper component 78 of the guide cylinder 52. The ducts 59 are thus connected with the annular groove 34, and are closed on their outer periphery of the annular shoulder 32 by threaded plugs 22. An internal duct 6 proceeds from the inner end of each connecting duct 59, and leads to the lower end surface of the upper component 78, and so as to be directed into the passageway 4 of the lower component of the guide cylinder. The four connecting ducts 59 may, for example, be provided on the periphery of the upper component 78 of the guide cylinder and accordingly, there may be associated four internal ducts 6 which extend along the imaginary surface of an acute angled cone. The lower end of the upper component 78 includes a threaded male end portion at 62, and the lower component 80 of the guide cylinder includes a female receptacle into which the end portion of the upper component 78 is threaded. The cover 33 is firmly bolted to the casing block 51, and includes an annular shoulder for securing the guide cylinder 52 in position.

Figure 15:
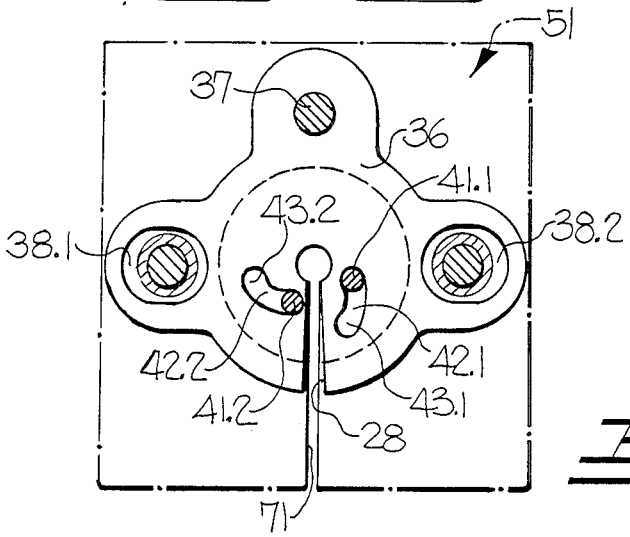
FIG. 15 is a sectional view taken substantially along the line 15—15 of FIG. 14 and illustrating the nozzle in its thread-up position.

The passageway 4, which may be termed a mixing channel, terminates in a diffuser 5, and leads into a stuffer box 23. The stuffer box is a relatively thin tube, which contains longitudinal slots 25 over a portion of its length. The longitudinal slots may be cut by a side milling cutter, and they serve the purpose of permitting the hot gas or vapor to escape from the stuffer box. The box is also provided with a threading slot 28, which extends over the entire length of the stuffer box, and is in alignment with the threading slot 71 in the casing block 51. The stuffer box also includes a flange 36, by which the box is mounted to the casing block 51 by means of a bolt 37 which is positioned on the side of the block 51 which is opposite to the threading slot 28. The flange 36 also includes oblong openings 38.1 and 38.2, located 90° from the bolt 37 as best seen in FIG. 15. By this arrangement, the flange is mounted to the casing block 51 so that the wall of the stuffer box 23 can perform limited radial movement for the purpose of opening and closing the threading slot 28. The guide cylinder has an end portion 39 which extends into a receptacle in upper end of the stuffer box 23, and both the end portion 39 and the receptacle of the stuffer box 23 have an oval cross section, with the two cross sections being of similar outline. Also, the stuffer box is manufactured so that it is internally biased so as to tend to naturally close the slot, which may be provided for example by surrounding it with a spring ring 40.

As illustrated in FIG. **13*b*, which is the operating position of the guide cylinder 52, the threading slot 70 of the guide cylinder 52 is non-aligned with the threading slot 71 of the casing block 51 and with the threading slot 28 of the stuffer box 23. In this operating position, the primary axes of the oval end piece 39 and of the oval receptacle of stuffer box 23 are aligned. As a result, the threading slot 28** of the stuffer box is closed by reason of the internal bias of the stuffer box.

FIG. **13*a* illustrates the threading position, and wherein all of the slots 70,71, and 28 are in alignment. By rotating the guide cylinder 52, the primary axis of the oval end piece 39 will lie along the small secondary axis of the oval receptacle of the stuffer box 23. As a result, the stuffer box 23 is spread open in the area of its threading slot 28**.

A feed system 24 is positioned below the stuffer box 23. As illustrated, the feed system 24 comprises two rotatably driven conveyor rolls, which are located on a plane normal to the axis of the stuffer box. The conveyor rolls are each provided with a groove 44 extending about its circumference, and these grooves of the conveyor rolls form a passage in the axial direction, the cross section of which substantially corresponds to the cross section of the stuffer box. This permits the yarn plug which is formed in the stuffer box to advance through the two conveyor rolls 24. Further details of a feed system of this type may be obtained from German AS No. 26 32 082.

Another embodiment of a yarn texturing nozzle in accordance with the present invention is illustrated in FIG. 14, with FIG. 15 illustrating the cross section of the stuffer box. In this embodiment, the inlet portion 20 of the nozzle comprises a casing 21 composed of the block 51 and cover 33, and a guide cylinder 52, substantially as described above with respect to FIG. 12. Also, the stuffer box 23 is secured to the bottom end of the casing block 51 in a manner similar to that described above with respect to FIG. 12. However, in the embodiment of FIG. 14, two pins 41.1 and 41.2 are provided at the end of the guide cylinder adjacent the stuffer box, and these pins are received in grooves 42.1 and 42.2 respectively, which are formed in the adjacent end of the stuffer box. The two grooves lie on opposite sides of the slot 28 as best seen in FIG. 15, and the grooves are approximately 90° out of phase relative to each other. As a result of this eccentricity, rotation of the guide cylinder 52 relative to the casing block 51 results in the pins 41.1 and 41.2 radially compressing or radially expanding the wall of the stuffer box. The end portions 43.1 and 43.2 of the two grooves extend substantially in the circumferential direction, and as soon as the pins 41.1 and 41.2 reach these end portions, the stuffer box is in its operating position, with the threading slot 28 being closed. Also, the threading slot of the guide cylinder 52 will be displaced substantially 90° with respect to the threading slot 71 of the casing block 51. The embodiment of FIG. 14 includes a feed system 24, as described above with respect to FIG. 12.

In the drawings and specification, there have been set forth preferred embodiments of the invention, and although specific terms are employed, they are used in a generic and descriptive sense only and not for purposes of limitation.

That which I claim is:

1. A yarn texturing nozzle comprising a rigid yarn feeding inlet portion comprising a casing having a cylindrical bore extending therethrough, and a guide cylinder rotatably received within said bore and extending along at least a substantial portion of the axial length of said bore, said guide cylinder having a yarn passageway extending axially through the length thereof and defining an inlet end and an outlet end, said casing having a slot extending axially along its length and laterally between said bore and the outer periphery of said casing, and said guide cylinder having a slot extending axially along its length and laterally between said yarn passageway and the outer periphery of said guide cylinder, and with the guide cylinder being rotatable with respect to said casing between a thread-up position wherein said slot of said guide cylinder is aligned with said slot of said casing and an operating position wherein said slots are non-aligned and said slot of said guide cylinder is covered by said casing, and with said guide cylinder further including at least one internal duct communicating with said yarn passageway and being inclined with respect to the axis of said passageway so as to be directed toward said outlet end, and conduit means for connecting said internal duct to a source of pressurized treatment fluid and such that the fluid entering said yarn passageway through said internal duct is adapted to advance a yarn through said yarn passageway and toward said outlet end, and a tubular stuffer box fixedly mounted with respect to said casing and so as to abut the outlet end of said yarn passageway in communication therewith, said stuffer box including a relatively thin peripheral side wall having opening means extending therethrough for permitting the treatment fluid to exhaust laterally through said side wall, and wherein said stuffer box further includes a yarn inserting slot extending through said side wall to facilitate yarn thread-up, with said slot of said stuffer box being aligned with said slot of said casing, and means for selectively closing said yarn inserting slot.

2. A yarn texturing nozzle as defined in claim 1, wherein said conduit means includes at least one delivery channel extending through said casing in a direction parallel to the axis of said bore, and such that the casing is adapted to be heated by the pressurized treatment fluid passing therethrough.

3. The yarn texturing nozzle as defined in claim 2 wherein said conduit means further includes connecting duct means extending radially into said guide cylinder and communicating with said at least one internal duct, and passageway means interconnecting said connecting duct means with said at least one delivery channel at least when said guide cylinder is in said operating position.

4. A yarn texturing nozzle as defined in claim 3 wherein said passageway means includes branch channels positioned in said casing so as to communicate with said connecting duct means of said guide cylinder at each of said thread-up position and said operating position.

5. The yarn texturing nozzle as defined in claim 1, wherein said guide cylinder includes a plurality of said internal ducts which communicate with said yarn passageway, and with said internal ducts being equally inclined with respect to the axis of said yarn passageway.

6. The yarn texturing nozzle as defined in claim 5 wherein said conduit means includes a distribution duct within said casing and at least partially surrounding said bore in a plane transverse to the axis of said bore, with said distribution duct communicating with a fluid inlet opening in said casing and also communicating with each of said internal ducts via a plurality of delivery channels which extend parallel to the axis of said bore in an equally spaced arrangement thereabout.

7. A yarn texturing nozzle as defined in claim 5 wherein said guide cylinder comprises a first component having a threaded male end defining a transverse end wall, with each of said internal ducts communicating with said transverse end wall, and a second component having a receptacle threadedly receiving said male end therein.

8. The yarn texturing nozzle as defined in claim 1 wherein said means for selectively closing said yarn inserting slot of said stuffer box comprises a plate movably mounted for selective movement into and away from said slot.

9. The yarn texturing nozzle as defined in claim 1 wherein said means for selectively closing said yarn inserting slot comprises an internal bias in said stuffer box tending to naturally close said slot therein, and cooperating cam surfaces mounted between said stuffer box and said guide cylinder whereby rotation of said guide cylinder in said casing to said thread-up position acts to open said slot in said stuffer box, and rotation to said operating position permits said slot to close.

10. The yarn texturing nozzle as defined in claim 1 wherein said means for selectively closing said yarn inserting slot comprises an internal bias in said stuffer box tending to naturally open said slot therein, and means for selectively exerting a radial force on said peripheral side wall so as to close said slot in said stuffer box.

11. The yarn texturing nozzle as defined in claim 10 wherein said means for selectively exerting a radial force on said peripheral side wall includes cooperating cam surfaces whereby rotation of said guide cylinder to said operating position acts to close said slot in said stuffer box, and rotation to said thread-up position permits said slot to open.

* * * * *